US009228331B1

(12) United States Patent
Weinstein

(10) Patent No.: US 9,228,331 B1
(45) Date of Patent: Jan. 5, 2016

(54) ADJUSTABLE SYSTEMS AND ASSOCIATED METHODS FOR SHIELDING UNDER-SINK PLUMBING

(71) Applicant: Hal Weinstein, Milton, GA (US)

(72) Inventor: Hal Weinstein, Milton, GA (US)

( * ) Notice: Subject to any disclaimer, the term of this patent is extended or adjusted under 35 U.S.C. 154(b) by 0 days.

(21) Appl. No.: 14/636,228

(22) Filed: Mar. 3, 2015

(51) Int. Cl.
*E03C 1/32* (2006.01)

(52) U.S. Cl.
CPC ..... *E03C 1/32* (2013.01); *E03C 2001/321* (2013.01)

(58) Field of Classification Search
CPC ..... E04C 2001/321; E04C 1/32
See application file for complete search history.

(56) References Cited

U.S. PATENT DOCUMENTS 2,542,046 A * 2/1951 Mullett et al. ..... 4/624
3,487,478 A * 1/1970 Harris ..... 4/619
3,915,524 A * 10/1975 Langston ..... 312/204
D238,075 S * 12/1975 Harris
D258,683 S * 3/1981 Wilson ..... D23/303
4,646,370 A * 3/1987 Risberg et al. ..... 4/661
4,862,528 A * 9/1989 Clarke et al. ..... 4/661
D315,337 S 3/1991 Weaver et al.
D332,654 S * 1/1993 Reid et al. ..... D23/308
5,253,376 A * 10/1993 Fait ..... 4/643
D358,634 S * 5/1995 Dannenberg et al. ..... D23/308
D372,077 S * 7/1996 Trueb et al. ..... D23/308
D373,412 S * 9/1996 Trueb et al. ..... D23/308
D375,154 S * 10/1996 Trueb et al. ..... D23/308
D384,732 S * 10/1997 Trueb et al. ..... D23/308
D387,144 S * 12/1997 Flaherty ..... D23/308
D390,643 S * 2/1998 Trueb et al. ..... D23/308
D393,700 S * 4/1998 Trueb et al. ..... D23/308
5,815,855 A 10/1998 McKeehan et al.
5,901,739 A 5/1999 Helmsderfer
D431,288 S * 9/2000 Helmsderfer ..... D23/308
D435,893 S * 1/2001 Helmsderfer ..... D23/308
6,739,353 B2 5/2004 Lechuga
D507,634 S * 7/2005 Loberger et al. ..... D23/308
6,938,283 B1 * 9/2005 Martinez ..... 4/630
7,100,633 B2 9/2006 Lechuga
D555,234 S * 11/2007 Soulier ..... D23/308
D556,304 S * 11/2007 Soulier ..... D23/308
D610,661 S * 2/2010 Kergoet ..... D23/308
7,721,365 B2 5/2010 Griffin et al.

(Continued)

OTHER PUBLICATIONS

Pipe Cover, Universal Lav Shield; http://www.grainger.com/product/TRUEBRO-Pipe-Cover-1ATD4; Mar. 19, 2015.

(Continued)

*Primary Examiner* — Andrew J Triggs
(74) *Attorney, Agent, or Firm* — Parks Wood LLC; Mickki D. Murray, Esq.

(57) ABSTRACT

The present disclosure describes an adjustable plumbing shield system comprising an adjustable shield component including a flexible sheet terminating at opposing ends with first connection parts. The system also includes two second connection parts configured to mate in a readily removable manner with the first connection components of the shielding. In various embodiments, the system is adjustable in one or more ways. The system can be configured, for instance, so that a vertical positioning of the shield component can be adjusted easily, without adjusting connections between a wall and the second connection parts. In another aspect, the shield component can be bowed, and the second connection parts arranged on the wall, to accommodate any of a variety of desired spacing and covering of under-sink fittings.

20 Claims, 8 Drawing Sheets

(56) References Cited

U.S. PATENT DOCUMENTS

| | | | | |
|---|---|---|---|---|
| D680,633 | S * | 4/2013 | Santiago | D23/308 |
| 9,004,096 | B2 * | 4/2015 | Gilbert | 137/355.28 |
| 2003/0163868 | A1 * | 9/2003 | Chiang et al. | 4/643 |

OTHER PUBLICATIONS

Truebro® Lav Shield® Protective Lavatory Enclosure | IPS Corporation; http://www.ipscorp.com/plumbing/truebro/lavshield; Mar. 19, 2015.

Parigi Lavatory Pedestal Only | Wayfair; http://www.wayfair.com/Kohler-Parigi-Lavatory-Pedestal-Only-2177- KOH1906.html; Mar. 19, 2015.

Sink Pedestal Provides Height of 31" to 36" |Wayfair; http://www.wayfair.com/keyword.php?keyword=Kohler-Sink-Pedestal-Provides-Height-of-31-To-36/3265-P-3265&command=dosearch &dept=0; Mar. 19, 2015.

NC1991 Commercial Tankless Water Heater; PlumbingSupply.com®; https://www.plumbingsupply.com/noritz-commercial-water-heater-nc199.html; Mar. 19, 2015.

Under-sink injury prevention products for the safety of wheelchair users; https://www.plumbingsupply.com/plumberex-under-sink-protection.html; Mar. 19, 2015.

Basin Guard,42 In,PVC,White by Truebro; https://www.acklandsgrainger.com/AGIPortalWeb/WebSource/ProductDisplay/globalProductDetailDisplay.do?item_code=WWG15W939; Mar. 19, 2015.

ICS Scrub Sink with Selectronic IC Faucet; http://www.americanstandard-us.com/commercial-sinks/ICS-Scrub-Sink-with-Automatic-Faucet-5602/; Mar. 19, 2015.

ABS High-Impact Plumbing Covers; http://www.norvaplastics.com/abs-high-impact-plumbing-covers.asp; Mar. 19, 2015.

ACE Stainless Steel Hand Sink w/ Foot Operated Valve; http://www.jks-tx.com/hand-sinks/82-ace-stainless-steel-hand-sink-w-foot-operated-valve-html; Mar. 19, 2015.

Installing a Pedestal Sink; http://www.diyadvice.com/diy/plumbing/bathroom/pedestal-sink/; Mar. 26, 2015.

Advance Tabco Pedestal Base for Hand Sinks with 10"x 14" Bowls; http://www.wayfair.com/Advance-Tabco-Pedestal-Base-for-Hand-Sinks-with-10-x-14-Bowls-7-PS-37B-ADVT1187.html; Mar. 26, 2015.

* cited by examiner

ADJUSTABLE SYSTEMS AND ASSOCIATED METHODS FOR SHIELDING UNDER-SINK PLUMBING

TECHNICAL FIELD

The present disclosure relates generally to systems and methods for shielding plumbing components and, more particularly, to a system and associated methods for shielding under-sink plumbing such as a trap, stop valves, and supply lines.

BACKGROUND

Stop valves, supply lines, and drainage components such as faucet tailpieces and traps for sinks are commonly shrouded by a cabinet or permanent pedestal. Cabinets or pedestals are often connected to the floor or wall and configured to connect to or fit snugly against a basin of the sink.

In some circumstances, under-sink plumbing is left exposed beneath an installed sink. This may be the case when the owner prefers the look of having the plumbing visible, for instance. Plumbing is also sometimes left uncovered after an initial sink installation, or uncovered temporarily when a cabinet or pedestal is removed as part of a renovation. Plumbing is also exposed in certain situations due to a design of the vanity or the "vessel" stand not being conducive to being covered by conventional means.

Leaving under-sink plumbing exposed can have drawbacks however. The facilities of public and commercial entities in the United States, for example, must comply with relevant accessibility standards of the Americans with Disabilities Act (ADA). Regarding plumbing fixtures, the Act includes requirements pertaining to restroom design and protection of the legs and feet of wheel-chaired individuals using sinks and lavatories.

Regarding exposed pipes and under-sink surfaces, specifically, the ADA requires that hot water and drain pipes under lavatories be insulated or otherwise configured to protect against contact with an individual using the plumbing fixture.

Another scenario in which exposed plumbing is disfavored, is when a new owner of a property does not like, or an existing owner no longer prefers, the look of having the pipes visible.

A cabinets or pedestal can be added in some cases, but doing so has associated challenges. Adding cabinets or pedestals is relatively expensive, and often cost prohibitive. Cabinets and pedestals are also generally permanent, whether connected fixedly connected to the sink basin, wall, and/or floor.

Moreover, design restraints or related form factors limit an ability to use such relatively complex conventional under-sink structures. In ongoing operation, cabinets and pedestals also inhibit access to the pipes for replacement or maintenance.

For situations in which covering is not required by law, owners also have an option of using expensive decorative drainage components (e.g., faucet tailpieces and traps) and stop valve assemblies. These products can be shaped and designed in aesthetic manners, such as by having expensive plating on the fittings. These products can be up to ten times more expensive than regular fittings. And use of these products can still lead to potential drawbacks down the road, such as becoming unsightly or being outside of new code.

SUMMARY

The present technology relates to a plumbing shield system comprising a shield component including a flexible sheet terminating at opposing ends with first connection parts. The system also includes two second connection parts configured to mate in a readily removable manner with the first connection parts of the shield.

In various embodiments, the system is adjustable in one or more ways, such as depth profile or width of coverage for the shield being installed. As another example, a vertical positioning of the shield can be adjusted as desired, such as for safety and/or appearance, without affecting an established connection between a wall and the second connection parts.

In one embodiment, the shield and second connection components are configured for being shipped in a generally flat arrangement, such as in a relatively flat-profile box or other relatively flat container.

The shield component in a particular implementation has a default bowed, curved, or curvilinear shape, while in another the shield component has a default shape that is generally flat.

In some embodiments, the shield component is configured and arranged in the system to extend at the respective lateral ends in a manner to shield the second connecting components from view when the shield component is installed around one or more under-sink plumbing fixtures.

In various embodiments, the adjustable shield system comprises one or more stabilizing components. The stabilizing component(s) can be flexible or movably connected to the shield, such as by hinge.

The adjustable shield system is in various embodiments sized and shaped according to a desired cost use. The use can include, for instance, covering a desired amount of any of an under-sink faucet tailpiece, trap, hot-water stop valve (or, hot input or intake) assembly, and cold-water stop valve (or, cold input or intake) assembly.

Other aspects of the present invention will be in part apparent and in part pointed out hereinafter.

Figure 1:
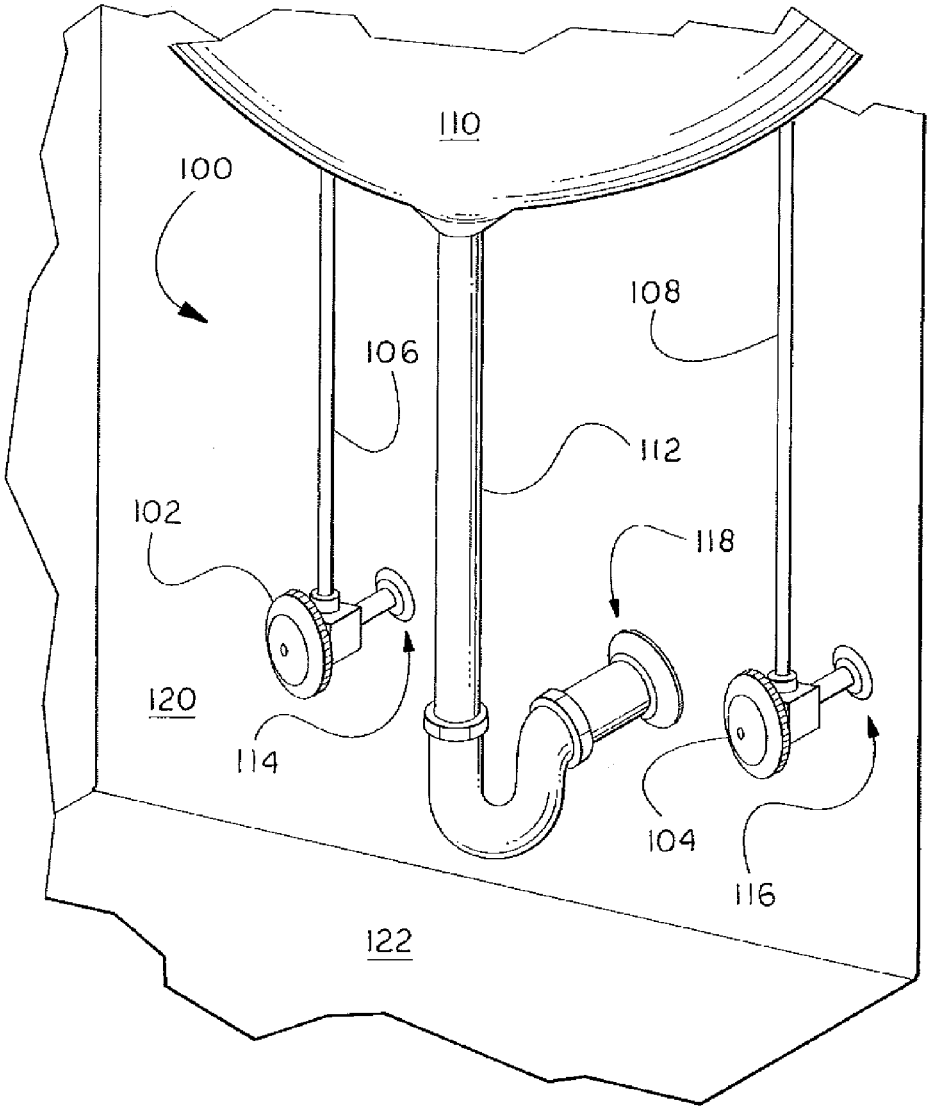
FIG. 1 illustrates a conventional under-sink plumbing arrangement.

The figures are not necessarily to scale and some features may be exaggerated or minimized, such as to show details of particular components. In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

DETAILED DESCRIPTION

As required, detailed embodiments of the present disclosure are disclosed herein. The disclosed embodiments are merely examples that may be embodied in various and alternative forms, and combinations thereof. As used herein, for example, exemplary, and similar terms, refer expansively to embodiments that serve as an illustration, specimen, model or pattern.

I. General Overview of the Disclosure

The present disclosure describes an adjustable plumbing shield system comprising an adjustable shield component including a flexible sheet terminating at opposing ends with first connection parts. The system also may include two second connection parts configured to mate in a readily removable manner with the first connection components of the shielding.

In various embodiments, the system is adjustable in one or more ways. The system can be configured, for instance, so that a vertical positioning of the shield component can be adjusted easily, without adjusting connections between a wall and the second connection parts. In another aspect, the shield component can be bowed, and the second connection parts arranged on the wall, to accommodate any of a variety of desired spacing and covering of under-sink fittings.

In various embodiments, the shielding and second connection components are configured for being shipped in a generally flat arrangement, such as in a relatively flat-profile box or other relatively flat container.

The shield component in various embodiments is configured (e.g., material and shape) to have shape memory. For instance in a particular implementation, the shield components is configured to have a default bowed shape so that it can be flattened for shipping and, when removed from its low-profile packaging, bows automatically to the bent shape for installation in a partially-surrounding manner around the exposed plumbing. The shape memory quality can result from the material of the shield and/or the manner of manufacture, such as molding or rolling the piece to be bowed, and comprising a material that will hold the bowed-bias between packaging and installation, including warehousing and shipping.

In another implementation, the shield component has a default flat shape and is easily bendable to a bent shape for installation, wherein the component is naturally flat for easy insertion to and removal from the flat packaging. In this case, the shield component, when removed from the packaging, is bowed or bent by an installer to any appropriate bent shape for installation in the partially-surrounding manner around the exposed plumbing.

In some embodiments, the shield component is configured and arranged in the system to extend at the respective ends in a manner to shield the second connecting components from view when the shield component is installed around the under-sink plumbing fixtures.

In various embodiments, the adjustable shield system comprises one or more stabilizing components. The stabilizing component(s) is in one implementation rotatably or at least pivotally connected to the shield component. The stabilizing component(s) can be connected to the shield component by a hinge, for instance. The stabilizing component(s) is configured and arranged in the system to removably connect the shield component to one or more of the covered under-sink plumbing fixtures, such as one or both stop valves, associated supply lines, and drainage components such as a faucet tailpiece and a trap (e.g., 'U' or 'S' trap).

The shield component and second connection components can include any of a wide variety of materials. Example materials include metal and/or plastic, such as ABS (acrylonitrile butadiene styrene), a PVC (polyvinyl chloride), or PE (polyethylene).

The adjustable shield system is in various embodiments sized and shaped according to a desired use. The system can be made available in multiple pre-determined arrangements, levels, or types, for instance. The arrangements can include, for example, a relatively low-end, or lower-cost, arrangement comprising a plastic shield component and mating hook-and-loop first and second connecting components. An example second, low-cost, arrangement can include a metal component and mating hook-and-slot, or slot/bracket, first and second connecting components.

While the present technology is described primarily in connection with use in covering under-sink plumbing, it is contemplated and hereby disclosed that the technology can be used to cover other fixtures. Target fixtures to be covered with benefits of the technology (e.g., covering in the easy, adjustable, removable/replaceable, cost effective, and decorative manners) include those that need to be shielded, such as due to heat, electricity, or radiation emanating therefrom, fixtures that must otherwise be covered per legal mandate, and fixtures that are thought unsightly. The technology is thus not limited to under-sink or even plumbing uses.

II. FIG. 1

Now turning to the figures, and more particularly the first figure, FIG. 1 illustrates a conventional under-sink plumbing arrangement 100. Arrangement fittings shown and described are merely exemplary, and the arrangement 100 can be configured differently, such as by including more or less of any of the fittings described, or by including other components in addition to or instead of those described.

The arrangement 100 includes a first stop valve 102 (or, first input or intake valve) and a second stop valve 104 (or, second input or intake valve). Typically, one of the valves 102, 104 is a hot intake valve and the other is a cold intake valve for the arrangement 100. The valves 102, 104 are connected to respective delivery pipes 106, 108 for delivering water to a faucet fixture (not shown) above a sink basin 110.

The fittings 102, 104, 112 and basin 110 are typically connected to a wall 120 behind the arrangement 100. Sometimes, one or more of the fittings extend from the floor 122.

Figure 2:
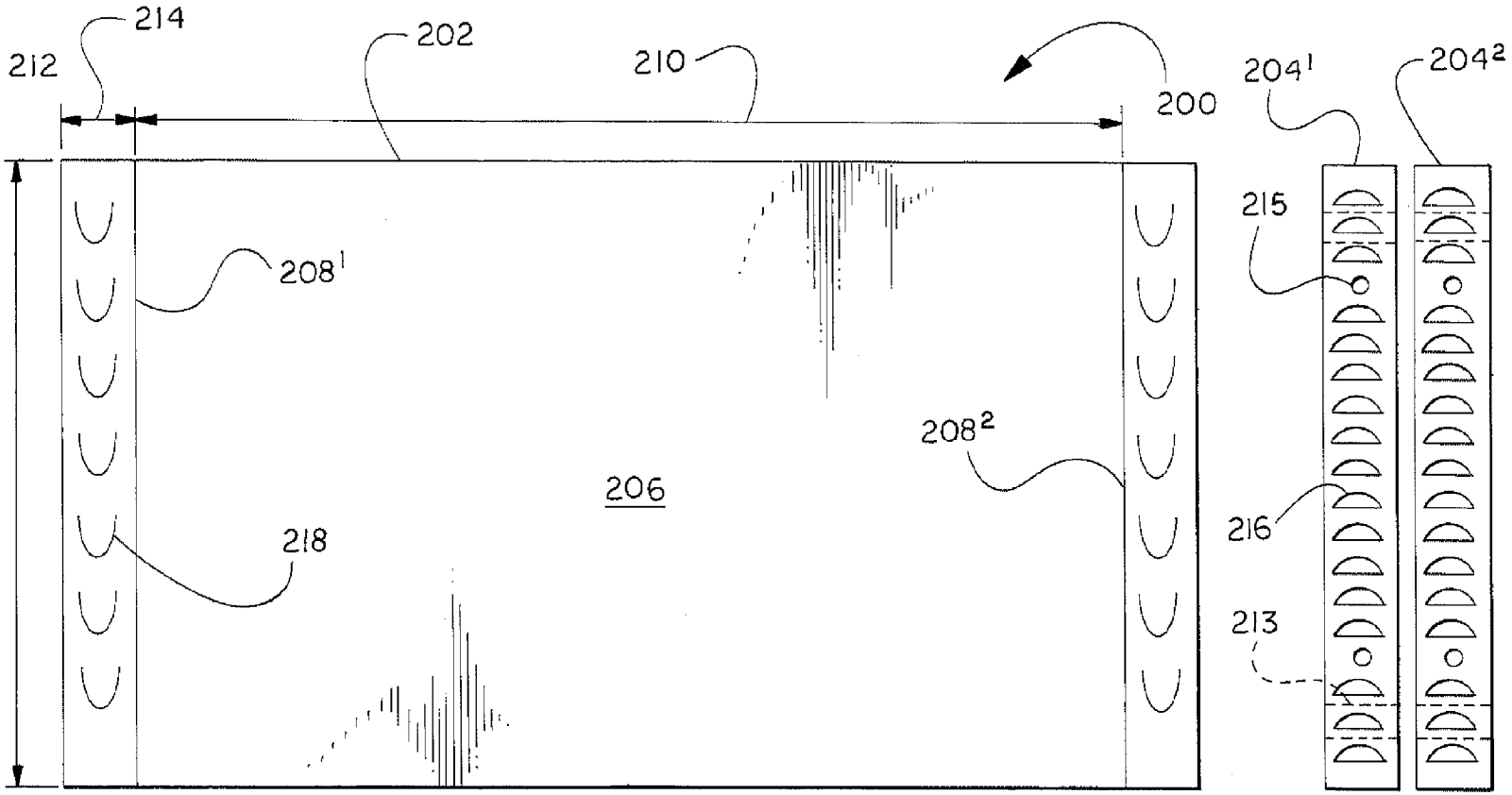
FIG. 2 illustrates a top, plan view of an adjustable plumbing shield system in a flat, shipping, mode, according to an embodiment of the present disclosure.
Figure 3:
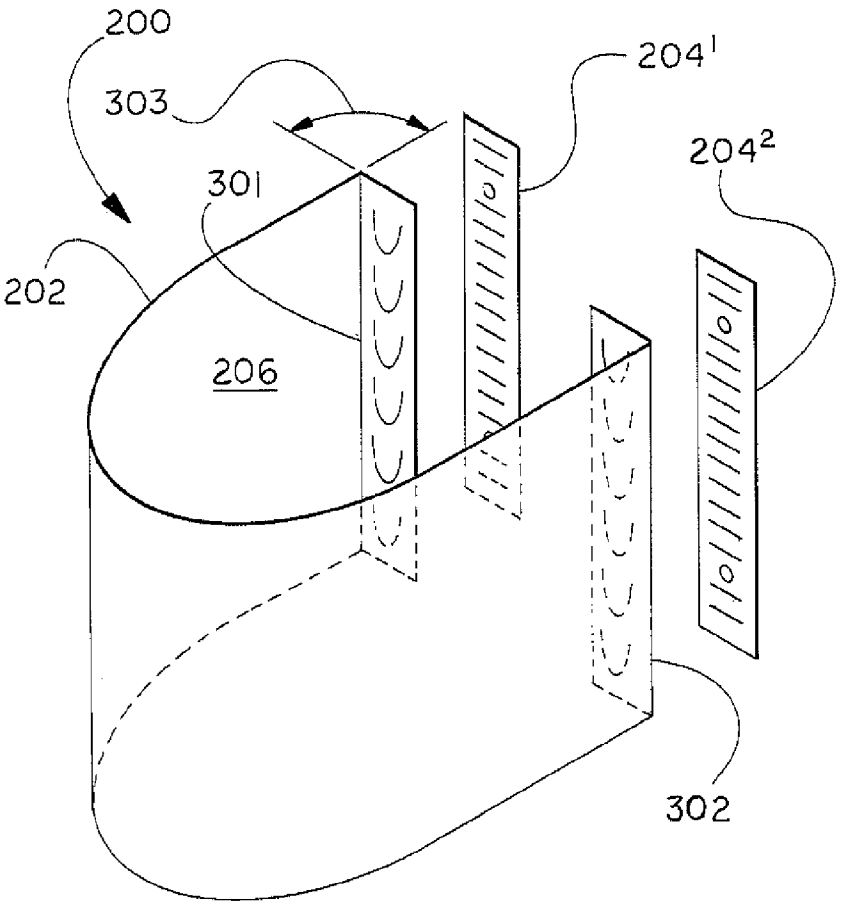
FIG. 3 illustrates the adjustable plumbing shield system of FIG. 2 in a bent, installation, mode, according to an embodiment of the present disclosure.
Figure 4:
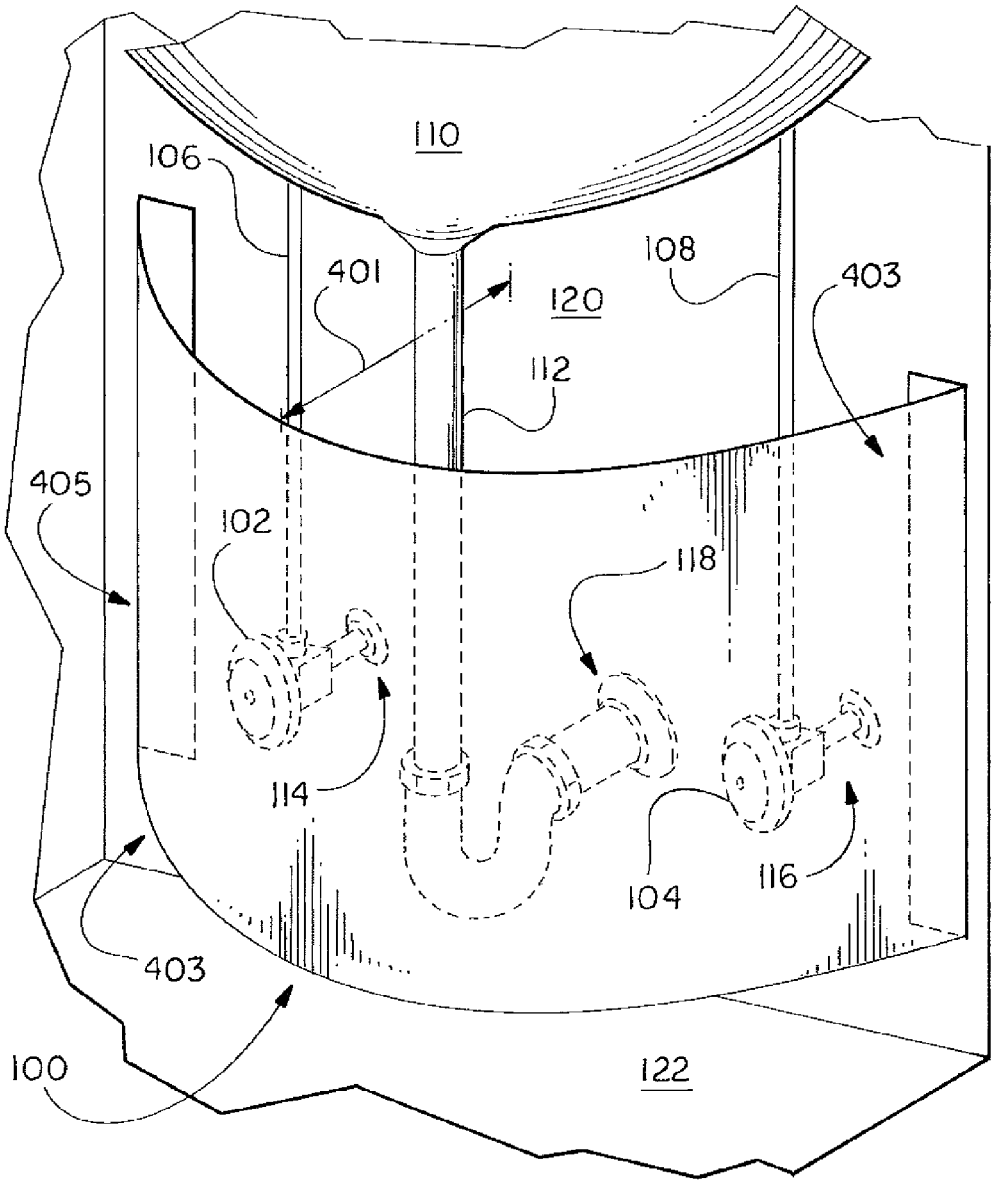
FIG. 4 illustrates the adjustable plumbing shield system of FIG. 2 installed to shield an under-sink plumbing arrangement, according to an embodiment of the present disclosure.

III. FIGS. 2 Through 4

FIG. 2 illustrates an adjustable plumbing shield system 200 in a flat, shipping, mode, according to an embodiment of the present disclosure.

The adjustable plumbing shield system 200 includes a primary shield component 202. As for all system parts of the embodiments taught herein, the shield component 202 can be referenced by other names. The shield component can be referred to as a covering component, a cover or covering assembly, a shield, shield component, shield cover, shield assembly, a cover apparatus, a decorative barrier, or the like. The component 202 will be described primarily herein using the term shield component.

The adjustable plumbing shield system 200 further comprises two mounting or connecting components 204$^1$, 204$^2$. The mounting components can also be referred to as brackets, mounting brackets, or mounting strips, for instance.

The system 200 can be referred to as adjustable for any of various reasons including those described herein. The adjustability can include easy changing of a vertical positioning of the shield component 202 on the wall 120 (FIG. 1), without upsetting a pre-established connection between the mounting parts 204 and the wall 120. The adjustability can also include an ability to likewise easily replace the shield component with a second shield component, again usually without upsetting the pre-established connection between the mounting parts 204 and the wall 120. While the term adjustability can be used to encompass such features of the present technology, the system 200 can likewise be referred to by terms related to the features, such as by being referred to as a removable system, an adjustable and removable system, an easily removable and easily adjustable system, and the like.

The shield component 202 includes a primary body portion 206 between two lateral connecting portions 208$^1$, 208$^2$. The lateral connecting portions 208$^1$, 208$^2$ of the shielding 202 are configured to connect readily and releasably to the mounting components 204$^1$, 204$^2$.

In one implementation, system components can be provided separately, such as in one or more kits, or pre-packaged sets. The shield component 202 can be sold or made available by a company separate from the mounting components 208.

While the shield component 202 can have other dimensions without departing from the scope of the present disclosure, in various embodiments the primary body portion 206 has a width 210 between of between about 30 inches and about 38 inches.

While the shield component 202 can have other heights, and more than one height in the same implementation (if the top or bottom edge were wavy, for example), in various embodiments the shield component 202 has a height 212 of between about 20 inches and about 24 inches.

And while the lateral connecting portions 208$^1$, 208$^2$ can have other widths, in various embodiments the lateral connecting portions each have a width 214 of between about ¾ inch and about 1 inch.

The mounting components 204$^1$, 204$^2$ are in some implementations sized and shaped the same or similar to the lateral connecting portions 208$^1$, 208$^2$. In most cases, the mounting components 204 will be generally elongate.

The mounting components 204$^1$, 204$^2$ can have a different size and shape than the lateral connecting portions 208$^1$, 208$^2$, though, such as by being shorter and/or thinner. Benefits of being smaller can include mounting components 204$^1$, 204$^2$ staying completely out of view or at least being less visible when the adjustable plumbing shield system 200 is installed.

In various embodiments, these brackets 204 will be shorter than the shield 202 itself so that they remain concealed in likely positionings of the shield 202 using the height adjustment function. In some embodiments, the components 204 are each shorter than the shield 202 by between about 2 inches and about 4 inches.

The relative sizing between the mounting components 204 and the lateral connecting portions 208 can also be pre-determined with consideration to an amount of adjustability in vertical height that may be needed in use of the system 200. It is in some embodiments preferred, for instance, that the mounting components 204 be smaller (e.g., shorter, or shorter and thinner) than the lateral connecting portions 208$^1$, 208$^2$, to allow easy adjustment of the vertical height of the shield component 202 within a pre-determined range of vertical shielding adjustment (again, needing to upset an established connection between the mounting component 204 and the wall 120). In this way, with each of the conceived vertical positions for the shield component 202, the mounting components 204 remain mostly, substantially, or completely concealed from view. Complete concealment between shield component height adjustments is generally preferred but not required for every implementation.

In some embodiments, the mounting components 204$^1$, 204$^2$ are configured to facilitate selective desired shortening, such as by having one or more perforations or break points 213. The configuration could also or instead include the components 204 being design to have thinner or otherwise more easily cuttable or breakable to facilitate the shortening. In addition to allowing greater vertical adjustment of the shield component while keeping the mounting components out of view, the ability to shorten also has a benefit of facilitating custom fitting applications, such as when space limitations beneath the sink would not allow the full original-sized mounting component without being shortened.

For installing the adjustable plumbing shield system 200 beneath the sink, the mounting components 204$^1$, 204$^2$ are connected to the wall (sink 110 and wall 120 shown in FIG. 1). The mounting components 204 can be mounted to the wall by screws (screw holes 215), nails, glue, tape, hooks to be embedded into the wall, or other suitable ways.

As mentioned, the mounting components 204$^1$, 204$^2$ and the lateral connecting portions 208$^1$, 208$^2$ are configured (e.g., size, shape, material) and, for installation, arranged, to mate thereby securing the shield component 202 to the mounting components 204$^1$, 204$^2$, and so to the wall 120.

The mounting components 204$^1$, 204$^2$ of the shield component 202 and lateral connecting portions 208$^1$, 208$^2$ can be configured for mating in any of a wide variety of ways. In case of FIG. 2, the mounting components 204$^1$, 204$^2$ comprise open or more first mating parts 216 configured (e.g., size, shape, material) to connect to one or more second mating parts 218 of the lateral connecting portions 208$^1$, 208$^2$.

In one embodiment, the mounting component mating part(s) include slots 216 for receiving tabs, protrusions, brackets, hooks, or anchors 218 extending from a surface of the lateral connecting portions 208$^1$, 208$^2$. In some embodiments, the described mating parts are switched—e.g., the first mating parts 216 can include tabs, protrusions, brackets, hooks, or anchors and the second mating parts 218 can include slots.

The mating parts 216, 218 are configured and arranged in use the mounting components 204, connected already to the wall.

In one embodiment, the mating parts 216, 218 of the mounting components 204[1], 204[2] and the lateral connecting portions 208[1], 208[2] include a hook-and-loop, or nylon-fastener, arrangement—e.g., VELCRO® (VELCRO is a registered trademark of Velcro Industries B.V., of the Netherlands).

In some embodiments the type (e.g., size, shape, material) of mating parts 216, 218 are selected so that the connection between the shield component 202 and the mounting components 204[1], 204[2] is adjustable easily in one or more ways. The mating parts 216, 218 can be configured so that the parts 216, 218 can easily be connected, for instance.

In addition, the mating parts 216, 218 can be configured so that a vertical positioning of the shield component 202 with respect to the wall 122 can be adjusted easily and without upsetting an existing connection between the mounting components 204 and the wall 120. Adjustability is facilitated by mating parts 216, 218 that are easily separable, and easy to re-position in a different vertical position.

In most cases, the mating parts 216, 218 are configured so that this can be done manually without any tool. These benefits also extend to circumstances in which a user would like to easily remove a shield component to replace it with another. The replacing shielding can be selected, like the first shielding, to have a preferred look or material for a desired performance—e.g., as heat barrier, or as a physical barrier to impact, such as from the feet or legs of wheelchair users.

In some embodiments, consideration in selecting a type of mating parts 216, 218 are selected to be cost effective while being fully functional for securing the shield component 202 to the mounting components 204 during use of the system 200.

The adjustable plumbing shield system 200 can be provided in multiple arrangements, styles, or types. The arrangements can include any combination of the features described herein. The arrangement used in a particular case can depend, for instance, on any of ease of installation, maintenance, removal, and adjustability, and cost of the product, storage (e.g., warehousing), shipping, handling, and installation.

The adjustable shield system 200 in various embodiments is designed or provided in any of (i) a relatively low-end, or lower-cost, arrangement, (ii) middle-end, or relatively low-cost, arrangement, (iii) a higher, high-end, arrangement, and a (iv) a commercial or industry grade arrangement.

The system can come in more or less, and different, arrangements than the four (i-iv) described here by way of example.

The low-end arrangement (i) can include a plastic shield component and mating hook-and-loop mating parts 204, 208, for instance. In most cases, the lateral connecting portions 208[1], 208[2] has the same material as the shielding body 206 (and can be formed integrally with the body portion), and the mounting components 204[1], 204[2] have generally the same or similar material as the lateral connecting portions 208[1], 208[2]. In other cases, the materials vary to some degree between the mounting components 204[1], 204[2], the body 206, and the lateral connecting portions 208[1], 208[2].

The other arrangements of the four arrangement (ii, iii, iv) can include some or all of these or other features described herein, and so this arrangement (i) can include any of the other features described herein.

The mid-level arrangement (ii) can include, for example, a metal shield component 202 and mating hook-and-slot, or slot bracket, first and second connecting components. The other arrangements of the four arrangement (i, iii, iv) can include some or all of these or other features described herein, and so this arrangement (ii) can include any of the other features described herein.

The high-end arrangement (iii) can include, for example, one or more fitting attachments (shown in FIGS. 8-13, for example). Some attachments, e.g., metal attachments are stronger and/or most expensive, than other attachments, e.g., plastic. The other arrangements of the four arrangement (i, ii, iv) can include some or all of these or other features described herein, and so this arrangement (iii) can include any of the other features described herein.

The commercial or industrial grade arrangement (iv) can include a shielding body 206 comprising or being connected to special material. In one implementation, the arrangement (iv) include a cell poly backing (not shown in detail), or a comparable backing, positioned on an inside (i.e., plumbing side) of the body 206. Benefits of such backing include the backing acting as an additional barrier, such as to heat, sound (e.g., pipe noises), radiation, or the like. The other arrangements of the four arrangement (i, ii, iii) can include some or all of these or other features described herein, and so this arrangement (iv) can include any of the other features described herein.

Features of the adjustable plumbing shield system 200 can be manufactured in any of a wide variety of methods without departing from the scope of the present disclosure. When the shield component 202 is made to include plastic, making the shield component 202 can include molding. When the shield component 202 is made of a metal, making the shield component 202 can include any of stamping and rolling, for instance.

In various embodiments, the shield component 202 and mounting connection components 204 are configured for being shipped in a generally flat arrangement, such as in a relatively flat-profile box or other relatively flat container (not shown). A flat shipping arrangement has benefits including (i) improved storage—e.g., for warehouse convenience, (ii) packability—i.e., ease of packing, such as for example on a delivery truck, and handling, and (iii) relative ease for delivery personnel carrying or otherwise moving (e.g., on pallets) the low-profile package. Flat packages are for these reasons, among others, generally less costly to ship, yielding another, resulting, benefit of a flat-packaging arrangement.

The shield component 202 in various embodiments is configured (e.g., material and shape) to have shape memory. For instance in a particular implementation, the shield components is configured to have a default bowed shape, similar to that shown in FIG. 3, so that it can be flattened, as shown in FIG. 2, for shipping and, when removed from its low-profile packaging (not shown), it bows automatically to the bowed shape (FIG. 3) for installation in a partially-surrounding manner around the exposed plumbing (FIG. 4).

In another implementation, the shield component 202 has a default flat shape (FIG. 2) and is easily bendable to a bowed shape (FIG. 3) for installation. The shield component 202 thus is naturally generally flat for easy insertion to and removal from relatively low-profile packaging (not shown). In this case, the shield component 202, when removed from the packaging, is bowed or bent by an installer to any appropriate bowed shape (FIG. 3) for installation in the partially-surrounding manner around the exposed plumbing (FIG. 4).

FIG. 3 illustrates the adjustable plumbing shield system 200 of FIG. 2 in a bowed, installation mode.

The shield component 202 and mounting components 204 can be made and/or covered or worked in a wide variety of ways for accomplishing desired function and look. The components 202, 204 can be made in any of a wide variety of materials, for instance. The shield components 202 can also be made with any of a variety of finishes or coverings, such as plating, coating, painting, or etching. Regarding coverings, in some embodiments, the shield component 202 is covered at least partially by a bendable covering (not shown in detail) having any of a myriad of designs and colors.

The shield component 202 can also have any of a variety of geometries, including but not limited to having bezeling or venting.

In a contemplated embodiment, one or more vents (not shown), which can be decoratively shaped, promote cooling of the fittings 102, 104, 112, such as by allowing ventilation of heat from the fittings out through the vent(s) and/or allowing air flow in through the vent(s) and over the fittings, thereby cooling warm or hot fittings 102 or 104, and 112.

The decorative options (e.g., cover, paint, venting, etching) that can be used allows a designer or end user to obtain a desired look without limiting primary function.

FIG. 4 illustrates the adjustable plumbing shield system 200 of FIG. 2 installed to shield the under-sink plumbing arrangement.

In some embodiments, the shield component 202 is configured and arranged in the system 200 to extend at the respective lateral ends—e.g., the connecting parts 208, in a manner to shield the mounting components 204 from view when the shield component is installed around the under-sink plumbing fixtures. For instance, the brackets 208 are not shown in the view of FIG. 4.

In the embodiments of FIGS. 3-8, the connecting components 208 are bent or folded with respect to the primary shielding body portion 206. In one embodiment, the shield component 202 is configured to facilitate bending or folding along the fold line 301 shown. The configuration can include, e.g., a crease or thinner material, or a pre-bent line at 301.

In various embodiments, the shield 202 is manufactured to have a pre-set angle 303 at line 301. The shield 202 can be formed or manipulated in a mold yielding the angle 303, for example. Presence of the angle 303 can facilitate installation in any of many ways. As mentioned, in some implementations, the shield 202 is packaged in a generally flat container.

For embodiments having some pre-bending 301, the container can be sized and shaped and/or the pre-bending can be configured to allow any of a few packing scenarios: (1) the shield is flattened some at the line 301 for fitting into the container so that the material maintains some bias when unpacked toward the original angle 303; and (2) the shield is not flattened at the line 301 so that the angle 303 is substantially or completely kept in place so that the shield 202 has the angle 303 during the shipping and as the shield 202 is being removed from the packaging, such as for the installation.

While the shield 202 may be formed so that the cover 206 is separated from the connecting components 208 by other angles 303 without departing from the present technology, in one embodiment the shield 202 is formed so that the cover 206 is separated from each connecting component by an angle of about 90 degrees. Other angles 303 are possible. The angle 303 may be, for example, within any of a variety of ranges, such as between about 5 or about 10 degrees and about 90 degrees, between about 45 degrees and about 90 degrees or between about 45 degrees and about 90 degrees.

Factors contributing to selection of a target angle 303 at the subject the shield 200 have include, but are not limited to: (A) ease of packing/unpacking, (B) ease of installation, (C) how well the shield 200 is supported when installed [e.g., how well supported at the wall via the connecting components 208 and/or by any intra-shield support components (e.g., those shown in FIGS. 8-12)] with the proposed angle 303, (D) desired or needed depth 401, and (E) how the shield 200, and particularly lateral portions 403 and/or edges 405, look when the shield 200 is installed. (400-series reference numerals shown in FIG. 4)

The shield component can be configured with other types of lateral edging, e.g., connecting components 208. The lateral component can include a slower or relatively gradual bend, such as the bend 1201 shown in FIG. 12.

In some embodiments (not shown in detail) in which the shield component 202 includes plastic, the shield components 202 is molded so that edges 302 of the body portion 206 extend or protrude further than the connecting portions 208. This allows the leading 302 edge to snug up, or be relatively flush, to the wall 120 without showing gaps between the shield component 202 and the wall 120 or between the shielding 202 and the mounting components 204.

For manufacturing the shield component of a metal, in some embodiments the cover is worked so that lateral edges 302, adjacent the connector parts 204, are folded or stamped back. This is performed in a way to accomplish the snug relationship mentioned for the plastic shield embodiments just mentioned.

Figure 5:
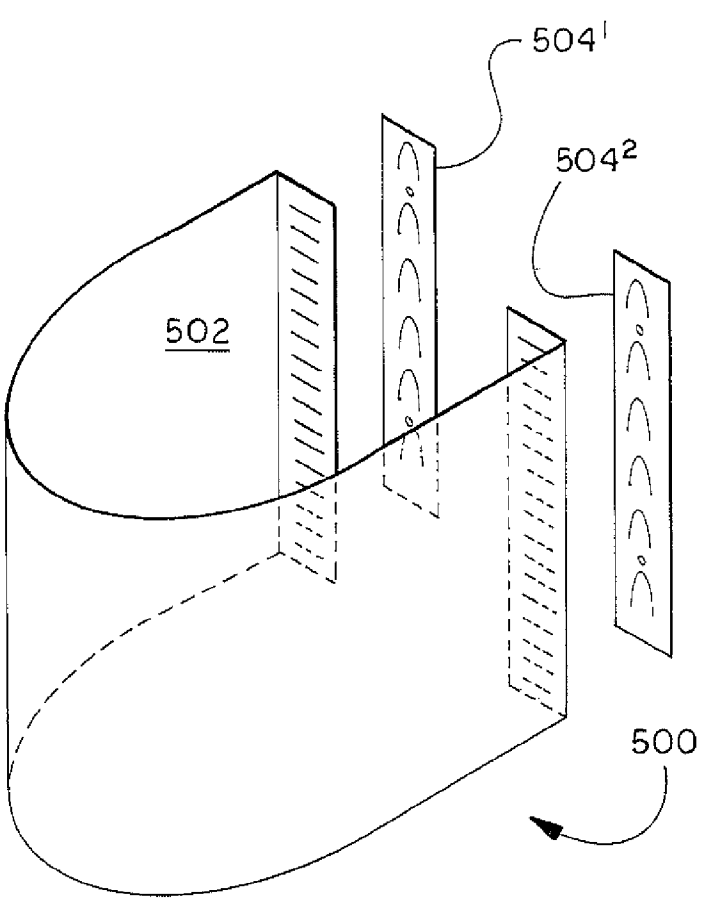
FIG. 5 illustrates an adjustable plumbing shield system in a bent mode, according to another embodiment of the present disclosure.
Figures 6, 7:
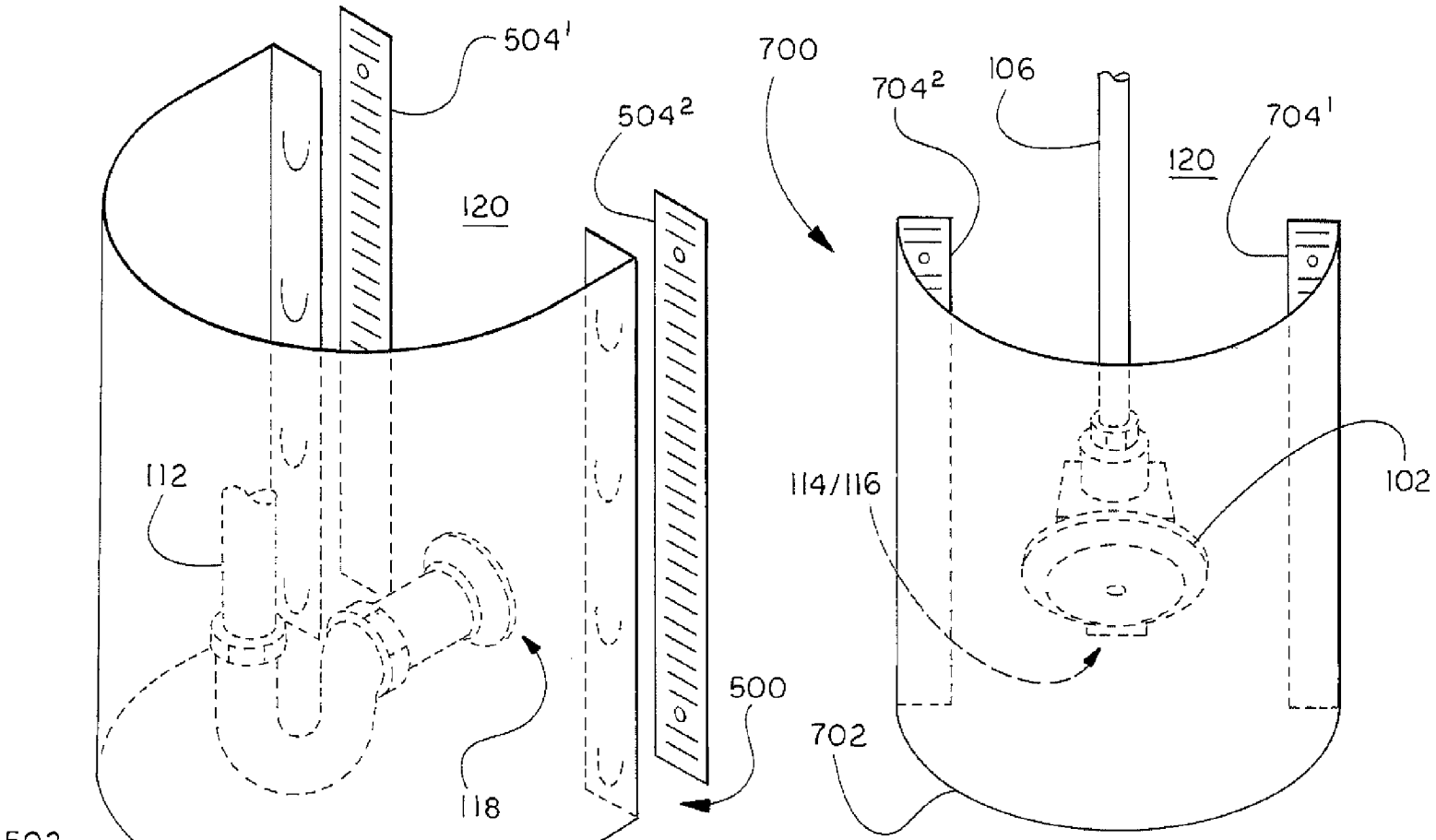
FIG. 6 illustrates the adjustable plumbing shield system of FIG. 5 installed to shield a drainage assembly of an under-sink plumbing arrangement, according to an embodiment of the present disclosure.
FIG. 7 illustrates the adjustable plumbing shield system of FIG. 5, according to another embodiment, installed to shield a stop valve and associated piping (e.g., hot input or intake) of an under-sink plumbing arrangement, according to an embodiment of the present disclosure.

IV. FIGS. 5 and 6

FIG. 5 illustrates an adjustable plumbing shield system 500 in a bent flat, mode, according to another embodiment of the present disclosure.

The shield systems of the present technology can, as mentioned, be configure (e.g., sized and shaped) to be a functional, cost effective, and easily adjustable barrier over any object or objects. As an example, the system can be sized and shaped to cover any one or more of the three primary under-sink fittings shown in FIG. 1.

The adjustable plumbing shield system 500 of FIG. 5 is like the system 200 of FIGS. 2-4 except that it is pre-designed to be narrower or otherwise smaller for implementation for covering select, but not all, under sink fittings. The adjustable plumbing shield system 500 can be sized to cover only one or more drainage components, such as the trap 112 (FIG. 1), and either of the stop valves 102, 104.

The embodiments of FIG. 5 can otherwise be like other embodiments described herein, and every similarity is not repeated here. For example, the brackets 504 can take any or all of the qualities described above in connection with the brackets 204 of FIGS. 2-4, and the shield component 502 can be like the shield component 202 of FIGS. 2-4. Configurations (e.g., size, shape, material) and arrangements (e.g., positionings, relative positionings) for the embodiments of the system of FIG. 5 can be the same, similar, or different in any one or more ways than those described in other sections herein for example.

FIG. 6 illustrates the adjustable plumbing shield system 500 of FIG. 5 installed at a wall 120 to shield one or more drainage components, such as a drain trap 112, of an under-sink plumbing arrangement, according to an embodiment of the present disclosure.

V. FIG. 7

FIG. 7 illustrates an adjustable plumbing shield system 700 of FIG. 5, according to another embodiment, installed to shield only just one stop valve and associated piping (e.g., hot input or intake lines) of an under-sink plumbing arrangement, according to an embodiment of the present disclosure.

The adjustable plumbing shield system 700 comprises a cover component 702 connected for installation to mounting components, or brackets, 704. The mounting components 704 are shown by broken line in FIG. 7, being behind the cover component 702.

The embodiments of FIG. 7 can otherwise be like other embodiments described herein, and every similarity is not repeated here. For example, the mounting components, or brackets 704 can take any or all of the qualities described above in connection with the brackets 204 of FIGS. 2-4, and the shield component 702 can be like the shield component 202 of FIGS. 2-4. Configurations (e.g., size, shape, material) and arrangements (e.g., positionings, relative positionings) for the embodiments of the system of FIG. 7 can be the same, similar, or different in any one or more ways than those described in other sections herein for example.

VI. FIGS. 8-11

Figure 8:
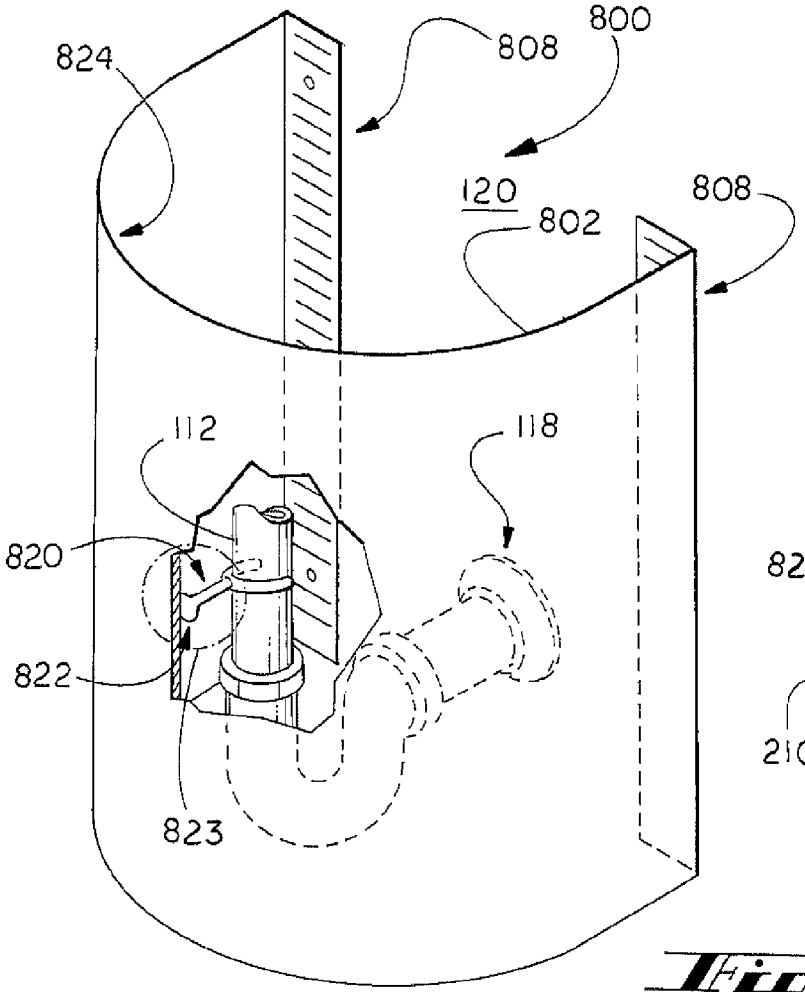
FIG. 8 illustrates an adjustable plumbing shield system installed to shield and releasably connect to a drainage assembly of an under-sink plumbing arrangement, according to an embodiment of the present disclosure.

FIG. 8 illustrates an adjustable plumbing shield system 800 installed to shield and releasably connect to one or more drainage components, such as the drain trap 112, of an under-sink plumbing arrangement, according to an embodiment of the present disclosure.

The adjustable plumbing shield system 800 of FIG. 8 includes features like earlier described embodiments of the present technology, including a shield component 802 comprising connector components 808 (mounting components, or brackets not shown).

In various implementations, the connector components 808 function after system installation to support the shield 800 partially using the fittings 102, 104 and/or 112. In most implementations, the connector components 808 supplement the shield support provided by connection of the shield to the wall via the wall-mounting components (e.g., brackets 204, 504). In a contemplated embodiment, one or more connector components 808 are used instead of using wall-mounting components.

The adjustable plumbing shield system 800 of FIG. 8 includes at least one support, or stabilizing, component 820, which can be referred to as an arm. The support component 820 is connected to the shield component 802 by support connecting structure 822 and configured to be connectable to one or more of the fittings to be concealed by the shield component 802.

The support component 820 can be connected to the shield 802 in any of a wide variety of ways. The connecting structure 822 can be a part of or connected to the support component 820.

Figure 12:
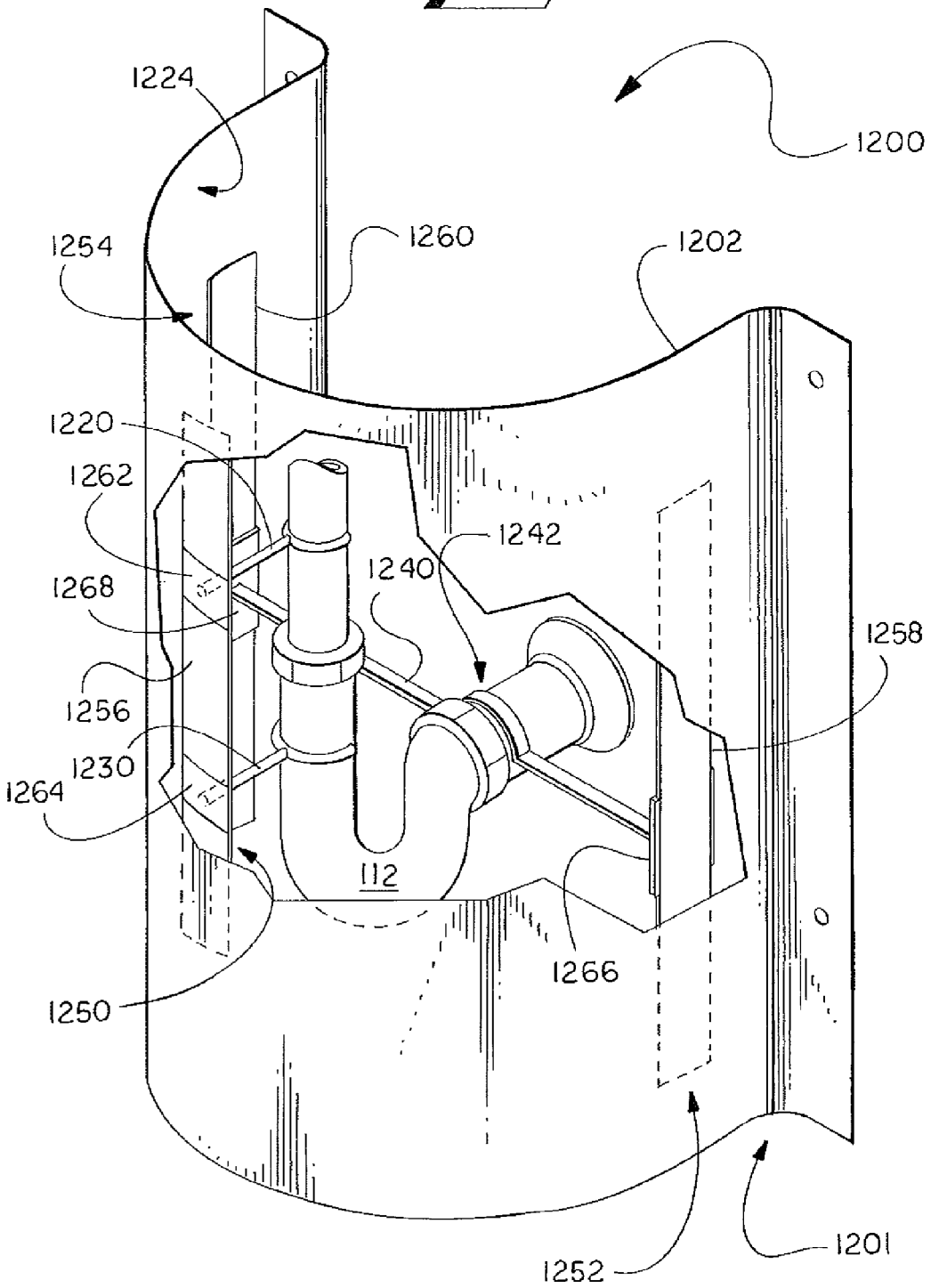
FIG. 12 illustrates an adjustable plumbing shield system installed to shield and releasably connect to a drainage assembly, e.g., to the trap and/or other components, at multiple locations of an under-sink plumbing arrangement, according to an embodiment of the present disclosure.

The connecting structure 822 can be, for example, rigid, hinged, or rotatable. In various implementations, the connecting structure 822 includes a rivet or weld material, such as from a spot weld joining the structure 822 and the shield wall 824. In some embodiments, the connecting structure 822 includes a hinge or a device allowing rotation of the support component 820 and the shield wall 824, such as a ball and socket joint. Another example of connecting structure is shown in FIG. 12 in connection with reference numerals 1250, 1252, 1254.

In one embodiment, the cover body 206 is configured or connected to a component that is configured, to receive or otherwise mate with the connecting structure 822. The cover-side connecting structure is indicated schematically by reference numeral 823 in FIG. 8.

In a particular implementation, the cover-side structure 823 includes a "punch," "notch" or such to receive a matching connecting structure 822, and to then stabilize the connecting structure 822 from moving vertically downward. The punch could be like the notch 216 shown in FIG. 2, for example. The mating structure 822 in this case could include a tab, hook, or the like for engaging the punch or notch. Such embodiments could still have various types of connecting structures 822 and support components 820, such as a hinged or ball and socket support component. The punch arrangement can be used, for example, for implementations in which the shield body 206 is metal.

In another implementation, the connecting structure 822 includes a tie, such as a nylon tie, cord, fastener, or the like, for connecting to the punch 823, thereby connecting the support structure 802 to the shield body 206.

In some embodiments, the support component 820 is flexible to allow bending to accommodate changes in relative orientation, between the support component 820 and the shield wall 824, and/or to accommodate changes in relative positioning between the component 820 and the fitting (e.g., trap 112) to which the support component is connected in installation of the system 800.

In a contemplated embodiment, the support component 820 is configured (e.g., size, shape, material) and/or arranged in the system 800 (e.g., position, orientation, connection type) to facilitate the flat packaging described above. In a contemplated embodiment, the support component 820 is flexible enough to facilitate this goal by being able to flex, in one or any of multiple directions, to a position that that reduces a top-to-bottom profile of the system 800 as compared to if the component 820 was not flexed, e.g., as it is being placed in a packaging box.

In some implementations, the support component 820 does not flex or does not flex much, has a length 900 (FIG. 9) and is arranged in the system 800 so that the support component 820 can extend between an inside wall 824 and the fitting (e.g., trap 112) to which the support component 820 is to connect in installation of the system 800, while having a low enough profile so as to still allow relatively flat packaging for the system 800.

Figure 9:
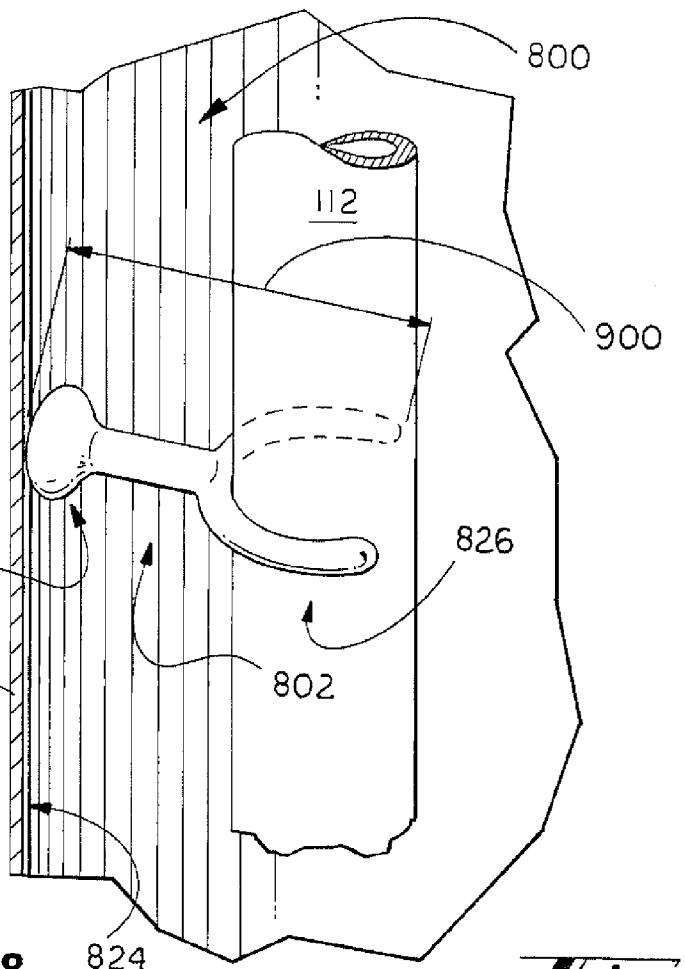
FIG. 9 illustrates a first example stabilizing connector of the adjustable plumbing shield system of FIG. 8 connected to the shield component of the system.

Each support component 820 connects at a linking portion 826 to one or more of the under-sink fittings 102, 104, 112. The linking portion 826 can be configured in any of a wide variety of ways for connecting to the fitting(s) including a U-shaped or C-shaped clamp, for instance, as shown in FIGS. 8 and 9.

Figure 10:
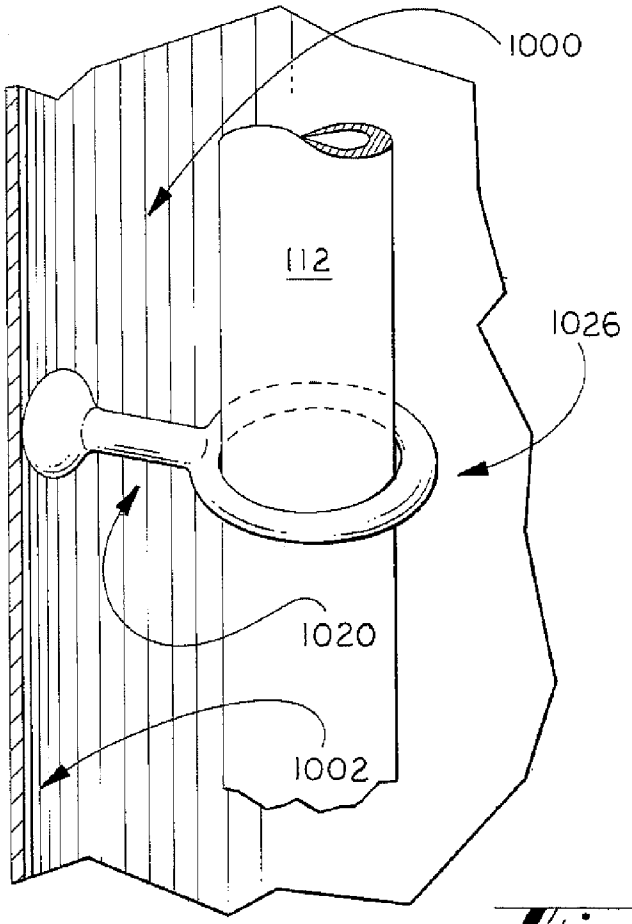
FIG. 10 illustrates a second example stabilizing connector of the adjustable plumbing shield system of FIG. 8 connected to the shield component of the system.

FIG. 10 shows a similar system 100, and particularly a support component 1020, according to another embodiment, installed between the shield 1002 and the drainage component(s), e.g., the trap 112. As another example linking portion, FIG. 10 shows the linking portion 1026 including a ring. The ring 1026 can be slipped over a pipe (e.g., trap 112) of the target fitting arrangement during installation of the system.

Figure 11:
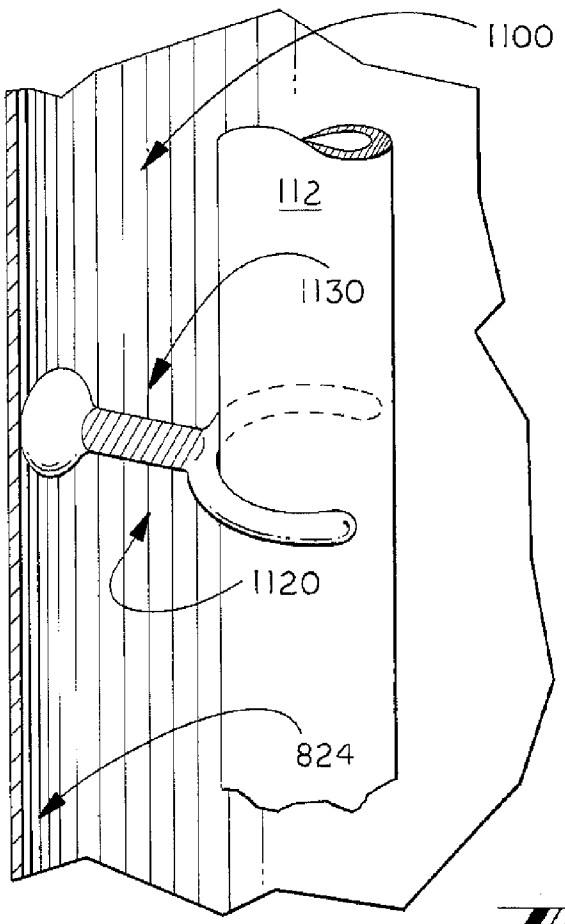
FIG. 11 illustrates a third example stabilizing connector of the adjustable plumbing shield system of FIG. 8 connected to the shield component of the system.

FIG. 11 shows a system 1100, and particularly a support component 1120, according to another embodiment, installed between the shield 1102 and drainage component(s), e.g., the trap 112. The support component 1120 includes an adjustable portion 1130. The portion can be configured to change the shape or orientation of the support component 1120 in one or more dimensions or directions, depending on the embodiment. The adjustable portion 1130 can be or include a threaded device, for instance, allowing lengthening or shortening of the support component 1120. In one embodiment, the adjustable portion 1130 includes a spring.

The support components 802, and related structure (e.g., connecting structure 822), can include any of a wide variety of appropriate materials. Example materials include metal or plastic, for instance.

The embodiments of FIGS. 8-11 can be like each other in any one or more ways, and otherwise like any of the other embodiments described herein, and every similarity is not repeated here.

VII. FIG. 12

FIG. 12 illustrates an adjustable plumbing shield system 1200 installed to shield and releasably connect to one or more drainage components, such as a drain trap at multiple locations of an under-sink plumbing arrangement, according to an embodiment of the present disclosure.

The system 1200 of FIG. 12 includes three support components 1220, 1230, 1240. The first two support component 1220, 1230 can in any ways be like those described above in connection with FIGS. 8-11.

The third support component 1240 has another configuration, being sized and shaped to extend between opposing part of the shield wall 1224, and comprising a receiving portion 1242. The receiving portion 1242 is sized and shaped, e.g., arched (or, arched portion), and positioned in the support component 1240 to rest on one of the fittings (e.g., 102, 104, 112) so that weight of the shield 1200 is supported by the fitting by way of the support component 1240.

As referenced, FIG. 12 shows another example of connecting structure 1250, 1252, 1254 connecting the support components 1220, 1230, 1240 to the shield wall 1224. The structures 1250, 1252, 1254 each include a base or slide 1256, 1258, 1260 and one or more slide mounts 1262, 1264, 1266, 1268.

In various embodiments, the slide mounts 1262, 1264, 1266, 1268 are slidably connected to the respective slides 1256, 1258, 1260. By the sliding, the supporting structures 1250, 1252, 1254 can be moved vertically at their base, connected to the slide mount, to a vertical desired position.

The adjustability for the system 1200 has benefits including allowing an installer to customize the shield 1200 for connecting robustly to the respective fitting(s) (e.g., trap 112), accommodating various fitting positions and locations by allowing various relative positionings between the shield 1200 and the fittings.

In a contemplated embodiment, the system 1200 additionally or alternatively includes one or more slide mounts oriented laterally or diagonally, as compared to the vertical orientation shown in FIG. 12.

VIII. Select Benefits and Advantages

Various benefits and advantages of the present technology are described above. These and some, but not all, benefits of the technology are described further here.

The adjustable plumbing shield systems taught herein provide a scald barrier to hot under-sink fittings. The systems are easy to install and remove, can be adjustable in vertical positioning, and designed or selected to meet function, overall appearance, and cost goals.

The adjustable plumbing shield systems of the present disclosure provide in the plumbing and interior-design industries an easy and cost-effective solution for selectively covering under-sink plumbing such as the drainage components and supply valve assemblies.

The systems of the various embodiments herein are also configured for ease and cost savings in re-installation storage, packing (i.e., ease of packing, such as on a delivery truck), and handling (e.g., ease in delivery personnel carrying or otherwise moving, such as on, pallets). These improvements result in lower cost associated with packing and handling, including generally lower shipping costs due to the package geometry. The configuration includes these systems being configured in a generally flat arrangement for pre-installation packaging, such as in a relatively flat-profile box or other relatively flat container.

The adjustable shield systems are also configured to facilitate easy installation. The configurations in one embodiment include the shield component having a default bent shape so that, when removed from the flat packaging, bends automatically to the bent shape for installation in a partially-surrounding manner around the exposed plumbing.

The configuration facilitating easy installation in another embodiment includes the shield component having a default flat shape and being easily bendable to a bent shape for installation. Therein, the component is naturally flat for easy insertion to and removal from the flat packaging. In this case, the shield component, when removed from the packaging, is bent by an installer to any appropriate bent shape for installation in the partially-surrounding manner around the exposed plumbing.

The shield component in some embodiments is configured and arranged in the system to extend at respective ends in a manner to shield the second connecting components. The arrangement results in a clean look for the system when installed, while still allowing easy removal and replacement of the same or a different shielding.

In various embodiments, the adjustable shield system comprises one or more intra-cover support, or stabilizing components. The stabilizing component(s) provide support for the cover, beyond that provided by the cover-to-mounting-strip connection. The additional support could allow liberties in the design of other areas of the system, such as by allowing use of a thinner, or less rigid cover material then would be appropriate if the additional support were not present.

Embodiments in which a general profile of such intra-cover support(s) is adjustable with respect to the cover, such as by being flexible or rotatably (e.g., hingedly) connected to the cover, promote the low-profile benefits mentioned above, such as ease and cost savings in packing, storing, and shipping.

The variety of materials that the cover can include provides flexibility in the function, installation, and cost of the product. The product can be made stronger with heavier materials (e.g., metal, copper, brass) at greater cost, or if very high strength is noted needed, cost can be saved by using a lighter material such as a plastic.

The flexibility in material, finishes (e.g., plating, coating, painting, etching), and to an extent geometry (e.g., edge shaping, bezeling, decorative vents) that can be used allows a designer or end user to obtain any desired look without limiting primary function. While blocking view to the under-sink fittings is one of the goals of the present technology in some embodiments, in contemplated embodiments, the shield component is opaque or substantially transparent.

In a contemplated embodiment, one or more vents, which can be decoratively shaped, promote cooling of the fittings, such as by allowing ventilation of heat from the fittings out through the vent(s) and/or allowing air flow in through the vent(s) and over the fittings, thereby cooling warm or hot fittings.

The variety of sizes and shapes in which the shield system can be provided promotes use in any desired of a wide variety of implementations. The system can be designed, for instance, to have a particular geometry corresponding to the particular implementation, such as by being designed to closely shroud one or more drainage components, such as a trap, and/or one or both stop valve assemblies without using excess material—i.e., without using more cover material than needed for the purpose.

The product in at least these ways provides installers, designers, and end users with a practical, easy, cost-effective, and decorative solution for shielding hot under-sink fittings for improved safety while avoiding an unsightly appearance of having the fittings exposed.

IX. Conclusion

Various embodiments of the present disclosure are disclosed herein. The embodiments are merely exemplary illustrations of implementations set forth for a clear understanding of the principles of the disclosure.

Variations, modifications, and combinations may be made to the above-described embodiments without departing from the scope of the claims. All such variations, modifications, and combinations are included herein by the scope of this disclosure and the following claims.

What is claimed is:

1. A shielding system, for blocking a fixture arrangement adjacent a mounting wall, comprising:

a shield having:

a primary shield body extending between opposing lateral ends; and a pair of connecting components, each being connected at a respective interface to one of the lateral ends, and each comprising a first mating part; and a pair of elongate mounting components, each being configured to allow attachment of the mounting component to the mounting wall to keep the mounting component secured in place against, and from moving away from, the mounting wall, and each comprising a second mating part corresponding to the first mating part allowing selective (i) attachment of the mounting component to a respective one of the connecting components for supporting the shield on the mounting wall during use of the system and (ii) removal of the second mating part from the respective one of the connecting components.

2. The shielding system of claim 1, further comprising a rigid supporting arm extending from the primary shield body and being configured to engage a fixture of the fixture arrangement, providing stability for keeping the shield in place when the system is installed at the mounting wall.

3. The shielding system of claim 1, wherein each connecting component is separated from the primary shield body by a pre-set angle of about 90 degrees at a respective one of the interfaces so that each connecting component is generally parallel to the mounting wall when the shielding system is installed on the mounting wall for use of the shielding system.

4. The shielding system of claim 1, wherein the first mating part and the second mating part comprise a hook-and-loop linking arrangement, wherein either:

the first mating part comprises a plurality of hooks and the second mating part comprises, for mating with the first mating part, a plurality of loops to mate with and thereby hold directly to the hooks of the first mating part; or the second mating part comprises the plurality of hooks and the first mating part comprises, for mating with the second mating part, the plurality of loops to mate with and thereby hold directly to the hooks of the second mating part.

5. The shielding system of claim 1, wherein each mounting component is shorter than each connecting component to ensure the mounting components are concealed when the connecting components are attached to the mounting components at any of various selectable vertical levels during use of the system.

6. The shielding system of claim 1, wherein the connecting components, including the first mating part, and the mounting components, including the second mating part, are configured so that each connecting component can be attached selectively to a respective one of the mounting components at any of multiple selectable vertical heights.

7. The shielding system of claim 1, wherein the primary shield body, after being formed, is flexible and has a default flat shape from which it is easily bendable, by personnel installing the shielding system on the mounting wall to block the fixture arrangement, from the default flat shape to a bowed shape for enclosing the fixture arrangement for use of the system.

8. The shielding system of claim 1, wherein the primary shield body, after being formed, is flexible and bends automatically to a default bowed shape, for enclosing the fixture arrangement, from a flat shape in response to personnel installing the shielding system removing the primary shield body being in the flat shape from a restraint holding the primary shield body in the flat shape.

9. The shielding system of claim 1, wherein the first mating part and the second mating part comprise a slot-and-hook arrangement, wherein either:

the first mating part comprises one or more hooks and the second mating part comprises, for mating with the first mating part, one or more corresponding slots to mate with the one or more hooks of the first mating part; or the second mating part comprises the one or more hooks and the first mating part comprises, for mating with the second mating part, the one or more corresponding slots to mate with the one or more hooks of the second mating part.

10. A shielding system, for blocking a fixture arrangement adjacent a mounting wall, comprising:

a shield having a primary shield body extending between opposing lateral ends; and a rigid supporting arm extending from the primary shield body and being configured and arranged in the shielding system to engage a drain pipe of the fixture arrangement thereby providing, when the system is installed, support for keeping the primary shield body in place adjacent the fixture arrangement.

11. The shielding system of claim 10, wherein the rigid supporting arm is connected to the primary shield body by way of a releasable attachment.

12. The shielding system of claim 10, wherein the rigid supporting arm, in being configured to engage the drain pipe, comprises a clipping formation for clipping around at least a portion of the drain pipe.

13. The shielding system of claim 10, wherein the rigid supporting arm, in being configured to engage the drain pipe, comprises a loop formation for surrounding at least a portion of the drain pipe.

14. The shielding system of claim 10, wherein the rigid supporting arm, in being configured to engage the drain pipe, comprises an arched section arranged in the rigid supporting arm to rest atop a portion of the drain pipe when the system is installed.

15. The shielding system of claim 10, wherein the rigid supporting arm, in being configured to engage the drain pipe connects to opposing interior walls of the primary shielding body and contacts the drain pipe when the system is installed.

16. The shielding system of claim 10, wherein the rigid supporting arm is connected to the primary shield body by way of a hinge.

17. The shielding system of claim 10, wherein:

the primary shield body includes a first attachment structure and the rigid supporting arm comprises a corresponding second attachment structure configured to engage the first attachment structure; and the first attachment structure includes a punch or notch arrangement formed in the primary shield body.

18. The shielding system of claim 10, wherein:

the primary shield body includes a first attachment structure and the rigid supporting arm comprises a corresponding second attachment structure configured to engage the first attachment structure; and the first attachment structure and the second attachment structure form a slide assembly allowing the first attachment structure to, when the first attachment structure is connected to the second attachment structure, slide vertically with respect to the second attachment structure and the primary shield body.

19. The shielding system of claim 18, wherein the first attachment structure comprises an elongate base extending vertically on the shield body, and the second attachment structure is configured to connect slidably to the first attachment structure allowing the first attachment structure to, when the first attachment structure is connected to the second attachment structure, slide vertically with respect to the second attachment structure and the primary shield body.

20. A fixture shielding system, for blocking a fixture arrangement adjacent a mounting wall, comprising:

a shield having:

a primary shield body extending between opposing lateral ends; and a pair of connecting components, each being connected to one of the lateral ends and comprising a first mating part; and a pair of elongate mounting components, wherein:

each of the pair of elongate mounting components comprises a second mating part corresponding to the first mating part;

the mounting components are separate from the connecting components and configured to be connected, manually by personnel installing the fixture shielding system to block the fixture arrangement, to the mounting wall and to the connecting components by connecting the first mating part to the corresponding second mating part; and when the mounting components are connected to the mounting wall and to the connecting components, the mounting components and the connecting components alone hold the shield to the mounting wall for use of the system to block the fixture arrangement.

* * * * *